US006273138B1

(12) United States Patent
Yoney

(10) Patent No.: US 6,273,138 B1
(45) Date of Patent: Aug. 14, 2001

(54) ADJUSTABLE FAUCET ASSEMBLY

(76) Inventor: James L. Yoney, R.R. #1, Box 118, Mount Morris, PA (US) 15349

( * ) Notice: Subject to any disclaimer, the term of this patent is extended or adjusted under 35 U.S.C. 154(b) by 0 days.

(21) Appl. No.: 09/569,636

(22) Filed: May 12, 2000

(51) Int. Cl.[7] ..... F16K 21/00

(52) U.S. Cl. ..... 137/801; 134/606; 4/678; 4/675; 4/567

(58) Field of Search ..... 137/801, 606; 4/678, 675, 567

(56) References Cited

U.S. PATENT DOCUMENTS

| | | | | |
|---|---|---|---|---|
| D. 354,114 | | 1/1995 | Mark . | |
| 4,266,320 | | 5/1981 | Grant . | |
| 4,502,165 | * | 3/1985 | Szemeredi et al. | 4/695 |
| 4,989,633 | | 2/1991 | Hupmert et al. . | |
| 5,135,173 | | 8/1992 | Cho . | |
| 5,230,109 | | 7/1993 | Zaccai et al. . | |
| 5,412,816 | | 5/1995 | Paterson et al. . | |
| 6,138,296 | * | 10/2000 | Baker | 4/678 |
| 6,209,153 | * | 4/2001 | Segien, Jr. | 4/695 |
| 6,220,278 | * | 4/2001 | Sauter et al. | 237/315.12 |

* cited by examiner

*Primary Examiner*—John Rivell
*Assistant Examiner*—Thomas L. McShane

(57) ABSTRACT

An adjustable faucet assembly for allowing easy access to the spigot to fill certain containers. The adjustable faucet assembly includes a support member having a main wall and a plurality of holes therethrough; and also includes a spigot having a tubular base member vertically extended through a first one of the holes with the spigot further having a tubular arm support member slidably mounted about an upper portion of the tubular base member and also having a tubular arm member pivotally mounted to the top end of the tubular arm support member; and further includes a spigot-clamping member having a split collar securely mounted upon the support member and mounted about the tubular arm support member and the tubular base member, and having a lever threaded through the ends of the split collar for engaging the collar about the tubular arm support member; and also includes a first and second tubular members extending through the remaining holes in the support member, and a first and second valve control members mounted to the first and second tubular members respectively.

8 Claims, 2 Drawing Sheets

ADJUSTABLE FAUCET ASSEMBLY

BACKGROUND OF THE INVENTION

1. Field of the Invention

The present invention relates to height-adjustable spigot for a faucet and more particularly pertains to a new adjustable faucet assembly for allowing easy access to the spigot to fill certain containers.

2. Description of the Prior Art

The use of height-adjustable spigot for a faucet is known in the prior art. More specifically, height-adjustable spigot for a faucet heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,989,633; 5,230,109; U.S. Pat. No. Des. 354,114; U.S. Pat. Nos. 5,412,816; 5,135,173; and 4,266,320.

While these devices fulfill their respective, particular objectives and requirements, the aforementioned patents do not disclose a new adjustable faucet assembly. The inventive device includes a support member having a main wall and a plurality of holes therethrough; and also includes a spigot having a tubular base member vertically extended through a first one of the holes with the spigot further having a tubular arm support member slidably mounted about an upper portion of the tubular base member and also having a tubular arm member pivotally mounted to the top end of the tubular arm support member; and further includes a spigot-clamping member having a split collar securely mounted upon the support member and mounted about the tubular arm support member and the tubular base member, and having a lever threaded through the ends of the split collar for engaging the collar about the tubular arm support member; and also includes a first and second tubular members extending through the remaining holes in the support member, and a first and second valve control members mounted to the first and second tubular members respectively.

In these respects, the adjustable faucet assembly according to the present invention substantially departs from the conventional concepts and designs of the prior art, and in so doing provides an apparatus primarily developed for the purpose of allowing easy access to the spigot to fill certain containers.

SUMMARY OF THE INVENTION

In view of the foregoing disadvantages inherent in the known types of height-adjustable spigot for a faucet now present in the prior art, the present invention provides a new adjustable faucet assembly construction wherein the same can be utilized for allowing easy access to the spigot to fill certain containers.

The general purpose of the present invention, which will be described subsequently in greater detail, is to provide a new adjustable faucet assembly apparatus and method which has many of the advantages of the height-adjustable spigot for a faucet mentioned heretofore and many novel features that result in a new adjustable faucet assembly which is not anticipated, rendered obvious, suggested, or even implied by any of the prior art height-adjustable spigot for a faucet, either alone or in any combination thereof.

To attain this, the present invention generally comprises a support member having a main wall and a plurality of holes therethrough; and also includes a spigot having a tubular base member vertically extended through a first one of the holes with the spigot further having a tubular arm support member slidably mounted about an upper portion of the tubular base member and also having a tubular arm member pivotally mounted to the top end of the tubular arm support member; and further includes a spigot-clamping member having a split collar securely mounted upon the support member and mounted about the tubular arm support member and the tubular base member, and having a lever threaded through the ends of the split collar for engaging the collar about the tubular arm support member; and also includes a first and second tubular members extending through the remaining holes in the support member, and a first and second valve control members mounted to the first and second tubular members respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable faucet assembly apparatus and method which has many of the advantages of the height-adjustable spigot for a faucet mentioned heretofore and many novel features that result in a new adjustable faucet assembly which is not anticipated, rendered obvious, suggested, or even implied by any of the prior art height-adjustable spigot for a faucet, either alone or in any combination thereof.

It is another object of the present invention to provide a new adjustable faucet assembly which may be easily and efficiently manufactured and marketed.

It is a further object of the present invention to provide a new adjustable faucet assembly which is of a durable and reliable construction.

An even further object of the present invention is to provide a new adjustable faucet assembly which is susceptible of a low cost of manufacture with regard to both materials and labor, and which accordingly is then susceptible of low prices of sale to the consuming public, thereby making such adjustable faucet assembly economically available to the buying public.

Still yet another object of the present invention is to provide a new adjustable faucet assembly which provides in the apparatuses and methods of the prior art some of the advantages thereof, while simultaneously overcoming some of the disadvantages normally associated therewith.

Still another object of the present invention is to provide a new adjustable faucet assembly for allowing easy access to the spigot to fill certain containers.

Yet another object of the present invention is to provide a new adjustable faucet assembly which includes a support member having a main wall and a plurality of holes therethrough; and also includes a spigot having a tubular base member vertically extended through a first one of the holes with the spigot further having a tubular arm support member slidably mounted about an upper portion of the tubular base member and also having a tubular arm member pivotally mounted to the top end of the tubular arm support member; and further includes a spigot-clamping member having a split collar securely mounted upon the support member and mounted about the tubular arm support member and the tubular base member, and having a lever threaded through the ends of the split collar for engaging the collar about the tubular arm support member; and also includes a first and second tubular members extending through the remaining holes in the support member, and a first and second valve control members mounted to the first and second tubular members respectively.

Still yet another object of the present invention is to provide a new adjustable faucet assembly that can be easily and conveniently installed in a user's kitchen or bathroom.

Even still another object of the present invention is to provide a new adjustable faucet assembly that allows oversized containers to be filled with water in a user's sink.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
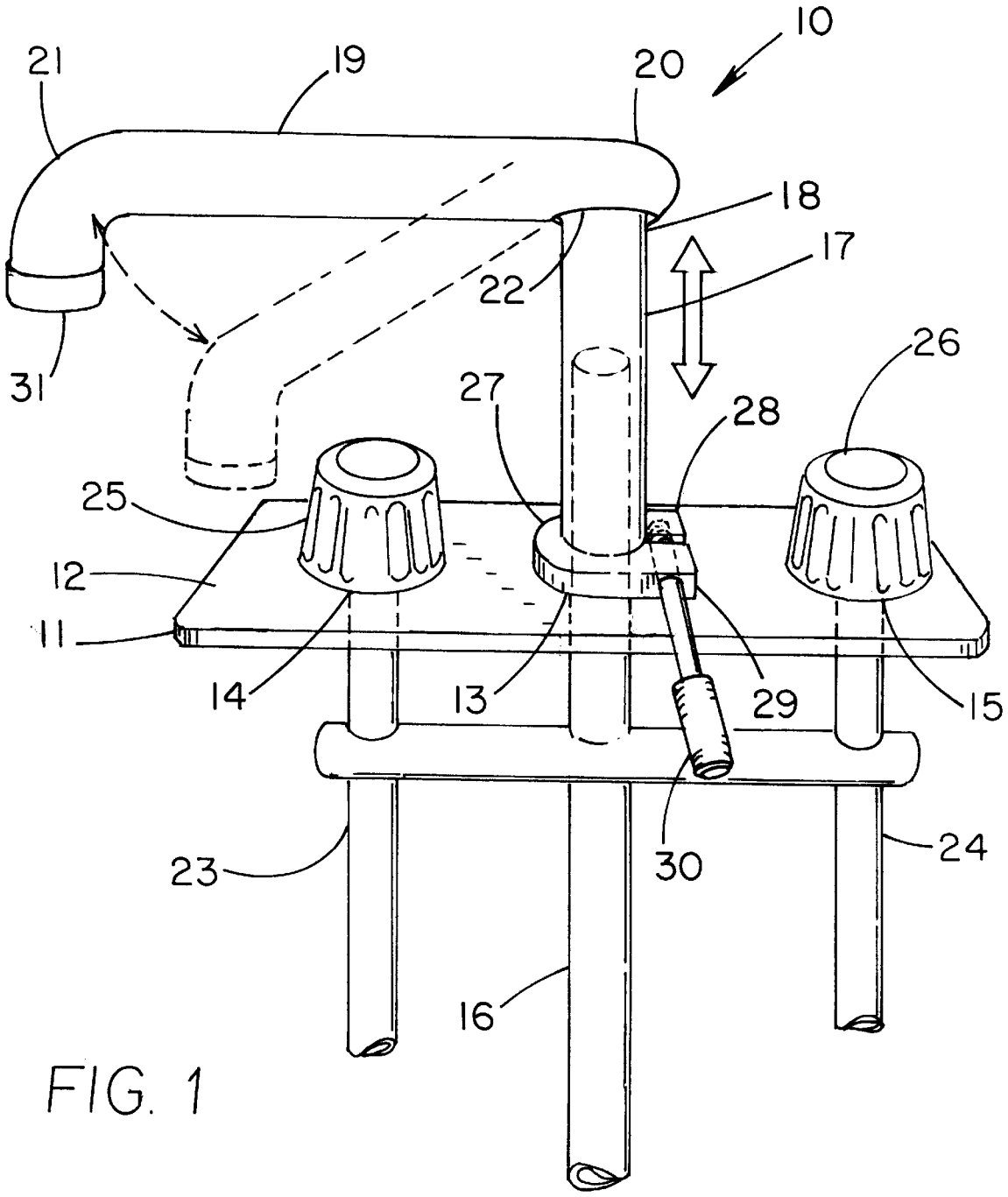
FIG. 1 is a perspective view of a new adjustable faucet assembly according to the present invention.
Figure 2:
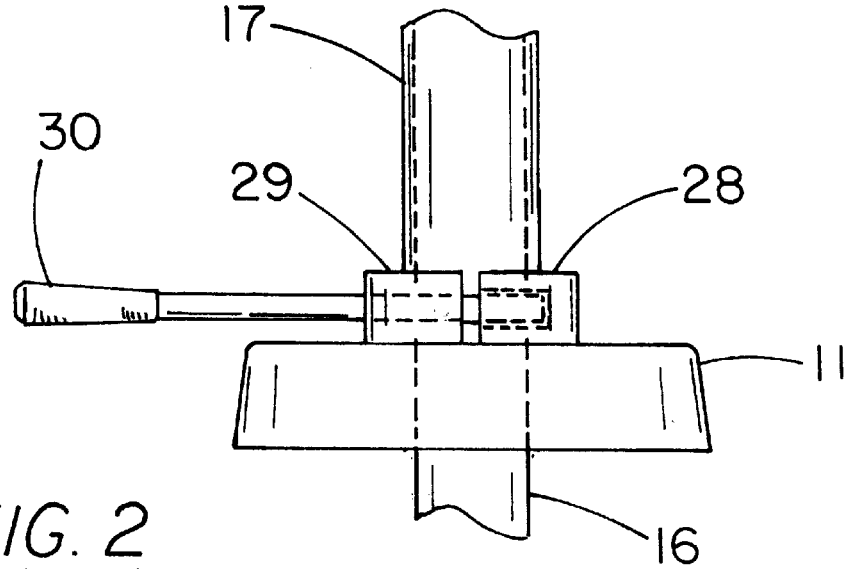
FIG. 2 is a detailed side elevational view of the present invention.
Figure 3:
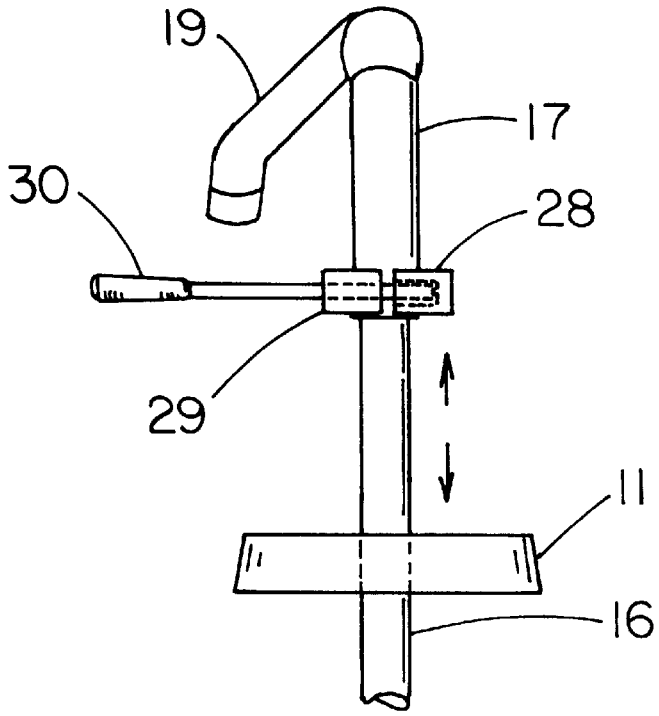
FIG. 3 is a slide elevational view of the present invention.

With reference now to the drawings, and in particular to FIGS. 1 through 3 thereof, a new adjustable faucet assembly embodying the principles and concepts of the present invention and generally designated by the reference numeral 10 will be described.

As best illustrated in FIGS. 1 through 3, the adjustable faucet assembly I0 generally comprises a support member 11 having a main wall 12 and a plurality of holes 13–15 spaced along and extending through the main wall 12. A spigot includes a tubular base member 16 movably disposed in a first one 13 of the holes, and a tubular arm support member 17 being slidably mounted about a top portion of the tubular base member 16, and a tubular arm member 19 being pivotally and conventionally mounted upon a top end 18 of the tubular arm support member 17. A spigot-clamping member includes a split collar 27 having a split therethrough and being mounted about the tubular arm support member 17 and the tubular base member 16 and being securely and conventionally mounted upon the support member 11, and further includes a lever 30 securely mounted to the split collar 27 for engaging and disengaging the split collar 27 about the tubular arm support member 17. The spigot-clamping member includes the split collar 27 having opposed enlarged ends 28,29 with the lever 30 having an end portion which is threaded through the enlarged ends 28,29 of the split collar 27 for opening and closing the split. The tubular arm support member 17 is adapted to move vertically in the first one 13 of the holes. Means for controlling flow of water through the spigot includes a first tubular member 23 securely and conventionally extended through a second one 14 of the holes and being connected to the tubular base member 16 and being adapted to be connected to a water source; and includes a first valve control member 25 conventionally mounted to the first tubular member 23 and upon the support member 11 for controlling flow of water to the spigot; and also includes a second tubular member 24 securely and conventionally extended through a third one 15 of the holes and being connected to the tubular base member 16 and being adapted to be connected to a water source; and further includes a second valve control member 26 securely and conventionally mounted to the second tubular member 24 and upon the support member 11 for controlling flow of water to the spigot. The tubular arm member 19 has a back end 20, a front end 21, and an opening 22 through a side of the tubular arm member 19 near the back end 20 thereof with the tubular arm member 19 being pivotally mounted upon the tubular arm support member 17 with the top end 18 of the tubular arm support member 17 extending into the opening 22. The tubular arm member 19 is horizontally pivotable about a vertical axis. An aerator member 31 is conventionally disposed at the front end 21 of the tubular arm member 19.

In use, the user can adjust the height of the tubular arm member 19 by disengaging the split collar 27 from about the tubular arm support member 17 by unthreading the lever 30 which opens the split in the collar 27. The user can raise or lower the tubular arm support member 17 as desired and securely lock the tubular arm support member 17 at that position by threading the lever 30 into the enlarged ends 28,29 of the split collar 27 which essentially closes the split and engages the collar 27 about the tubular arm support member 17.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable faucet assembly comprising:

a support member having a main wall and a plurality of holes spaced along and extending through said main wall;

a spigot including a tubular base member movably disposed in a first one of said holes, a tubular arm support member slidably mounted about an upper portion of said tubular base member, and a tubular arm member being pivotally mounted upon a top end of said tubular arm support member;

a spigot clamping member including a split collar having a split therethrough and being mounted about said tubular arm support member and said tubular base member and being securely mounted upon said support member, and further including a lever mounted to said split collar for engaging and disengaging said split collar about said tubular arm support member; and means for controlling flow of water through said spigot.

2. An adjustable faucet assembly as described in claim 1, wherein said spigot-clamping member includes said split collar having opposed enlarged ends.

3. An adjustable faucet assembly as described in claim 2, wherein said lever has an end portion which is threaded through said enlarged ends of said split collar for opening and closing said split.

4. An adjustable faucet assembly as described in claim 3, wherein said tubular arm support member is adapted to move vertically in said first one of said holes.

5. An adjustable faucet assembly as described in claim 4, wherein said means for controlling flow of water through said spigot includes a first tubular member securely extended through a second one of said holes and being connected to said tubular base member and being adapted to be connected to a water source; a first valve control member mounted to said first tubular member and upon said support member for controlling flow of water to said spigot; a second tubular member securely extended through a third one of said holes and being connected to said tubular base member and being adapted to be connected to a water source; and a second valve control member mounted to said second tubular member and upon said support member for controlling flow of water to said spigot.

6. An adjustable faucet assembly as described in claim 5, wherein said tubular arm member has a back end, a front end, and an opening through a side of said tubular arm member near said back end thereof, said tubular arm member being pivotally mounted upon said tubular arm support member with said top end of said tubular arm support member extending into said opening, said tubular arm member being pivotable about a vertical axis.

7. An adjustable faucet assembly as described in claim 6, further includes an aerator member disposed at said front end of said tubular arm member.

8. An adjustable faucet assembly comprising:

a support member having a main wall and a plurality of holes spaced along and extending through said main wall;

a spigot including a tubular base member movably disposed in a first one of said holes, and a tubular arm support member being slidably mounted about said tubular base member, and a tubular arm member being pivotally mounted upon a top end of said tubular arm support member;

a spigot clamping member including a split collar having a split therethrough and being mounted about said tubular arm support member and said tubular base member and being securely mounted to said support member, and further including a lever mounted to said split collar for engaging and disengaging said split collar about said tubular arm support member, said spigot-clamping member including said split collar having opposed enlarged ends, said lever having an end portion which is threaded through said enlarged ends of said split collar for opening and closing said split, said tubular arm support member being adapted to move vertically in said first one of said holes; and means for controlling flow of water through said spigot including a first tubular member securely extended through a second one of said holes and being connected to said tubular base member and being adapted to be connected to a water source; a first valve control member mounted to said first tubular member and upon said support member for controlling flow of water to said spigot; a second tubular member securely extended through a third one of said holes and being connected to said tubular base member and being adapted to be connected to a water source; and a second valve control member mounted to said second tubular member and upon said support member for controlling flow of water to said spigot, said tubular arm member having a back end, a front end, and an opening through a side of said tubular arm member near said back end thereof, said tubular arm member being pivotally mounted upon said tubular arm support member with said top end of said tubular base member extending into said opening, said tubular arm member being pivotable about a vertical axis; and an aerator member disposed at said front end of said tubular arm member.

* * * * *